US006398385B1

(12) United States Patent
Lin

(10) Patent No.: US 6,398,385 B1
(45) Date of Patent: Jun. 4, 2002

(54) FIXED-DEVICE FOR THE BULB SOCKET

(76) Inventor: Chi-Hua Lin, No. 304, Hsin-Sen Road, Chu-Dong, Hsin-chu (TW)

( * ) Notice: Subject to any disclaimer, the term of this patent is extended or adjusted under 35 U.S.C. 154(b) by 0 days.

(21) Appl. No.: 09/546,175

(22) Filed: Apr. 11, 2000

(51) Int. Cl.[7] ..... H01R 33/00

(52) U.S. Cl. ..... 362/226; 362/457; 439/699.2; 439/360; 439/280

(58) Field of Search ..... 362/226, 457; 439/360, 280, 699.2, 414, 419

(56) References Cited

U.S. PATENT DOCUMENTS 5,833,356 A * 11/1998 Yamamoto et al. ..... 362/294
6,056,417 A * 5/2000 Cheng ..... 362/226
6,250,970 B1 * 6/2001 Key et al. ..... 439/699.2

* cited by examiner

*Primary Examiner*—Sandra O'Shea
*Assistant Examiner*—Jacob Y. Choi
(74) *Attorney, Agent, or Firm*—Rabin & Berdo, P.C.

(57) ABSTRACT

The present invention relates to an improved fixed-device for the bulb socket having a chunking member installed at one side of leading-in socket of the said bulb socket, wherein it comprises a plurality of concaved ratchets, a fixed-frame having a pressing piece, and in addition there are exserted ratchets, which are positioned at the place opposite to the said chunking member, snapped at each other in order to achieve the characteristic of rapid assembly and firmly fastening consequently.

4 Claims, 7 Drawing Sheets

FIXED-DEVICE FOR THE BULB SOCKET

FIELD OF THE INVENTION

The present invention relates to the field of a bulb, and more particularly it is directed to a kind of improved fixed-device for a bulb socket having a leading-in socket which is chucked and coupled firmly by a fixed-frame so as to achieve the characteristics of rapid assembly and consequently firmly fastening.

BACKGROUND OF THE INVENTION

With the rapid recent development in the field of automobile technology, there is an improvement for the bulb assembly which is different than the common bulb with brass-made bulb sockets used in the past years. The improved bulb assembly has a bulb socket (11), which is a non-electric conductor, installed onto one side of the glass shell (10). With reference to the FIG. 1, extending from one side of the bulb socket (11) is a straight leading-in socket (12). The lead wire (13) of the electrode protrudes out of the leading-in socket (12) of the bulb socket (11). The lead wire (13) is lined up in two rows and also bended further in order to be abutted against the surface of the leading-in socket (12). Leading-in socket (12) is fixed by using a fixed-frame (15) affixed onto the leading-in socket (12). Therefore, the fixed-frame (15) will be able to lead the lead wire (13) so that it could be fixed properly in order to be connected to the bulb socket and further to the applicable power supply accordingly.

In spite of the advantages such as rapid assembling, and affixing firmly without falling off during driving the automobile for the above bulb socket, there is still a necessary method, such as high frequency welding, that needs to be performed while the fixed-frame (15) is affixed onto the leading-in socket (12), which means it needs to have the fixed-frame (15) affixed onto the leading-in socket (12) by means of the method of high frequency welding during the production, and in such way that it will not only increase the cost on the production with an additional procedure, but also will have a serious problem on the pollution to the ambient environment with a result of producing toxic gas during the operation of the high frequency welding.

Additionally, as the surface of the leading-in socket (12) on the bulb socket (11) is straight, it is impossible for the lead wire (13) to be affixed onto the fixed position after it is bended and abutted against the leading-in socket (13). This results in the deflection or the displacement on the lead wire (13), and at the same time while the fixed-frame (15) is to be affixed onto the leading-in socket (12) and also at the time while the fixed-frame (15) is depressing on the lead wire (13), it has deflected totally. Therefore, the lead wire (13) will be useless after the fixed-frame (15) has been installed onto the bulb socket (11). Furthermore, owing to the fact that the lead wire (13) which is only abutted on the surface without having a fixed position to be affixed on so that in this way all the lead wire (13) including the bulb socket (11) coupled with the bulb holder will then have the defects that is not only dropped off easily from the holder but also impossible to be aligned with the position of the positive/negative electrodes.

The inventor, in view of the above, based on the quite remarkable experience on designing and producing the relative products in so many years and thus provides the present invention with all the advantages of rapid assembly and low production cost but without any pollution problem to our ambient environment as all.

SUMMARY OF THE INVENTION

It is a major object of the present invention to provide an improved fixed-device for the bulb socket, wherein the bulb socket has a leading-in socket affixed onto a fixed-frame, and it is coupled with each other by means of the chucking member and the blocking member so as to be assembled rapidly.

The secondary object of the present invention is to provide an improved fixed-device for the bulb socket, wherein with which both the invaginated and the protruded portion of the chucking member and the blocking member will be able to couple firmly with each other, and also its slopes will extend to the same direction as well so that it is able to couple firmly with each other without falling off at all.

According to the preferred configuration "characteristic" effect and advantage of the invention, an embodiment of the present invention will now be described by way of a preferred example with reference to the accompanying drawings:

BRIEF DESCRIPTION OF NUMBERS IN ILLUSTRATION ACCORDING TO THE KNOWN BULB ASSEMBLY

| | |
|---|---|
| (10) Glass shell | (11) Bulb socket |
| (12) Leading-in socket | (13) Lead wire |
| (15) Fixed-frame | |

BRIEF DESCRIPTION OF NUMBERS IN ILLUSTRATION ACCORDING TO THE PRESENT INVENTION

| | |
|---|---|
| (20) Bulb socket | (21) Leading-in socket |
| (22) Chucking member | (23) Plane |
| (24) Slope | (25) Glass shell |
| (26) Lead wire | (211) Locating groove |

-continued

| | |
|---|---|
| (30) Fixed-frame | (31) Central hole |
| (32) Pressing piece | (33) Slope |
| (34) Blocking member | (35) Plane |
| (36) Slope | (37) Locating post |

DETAILED DESCRIPTION

Figure 1:
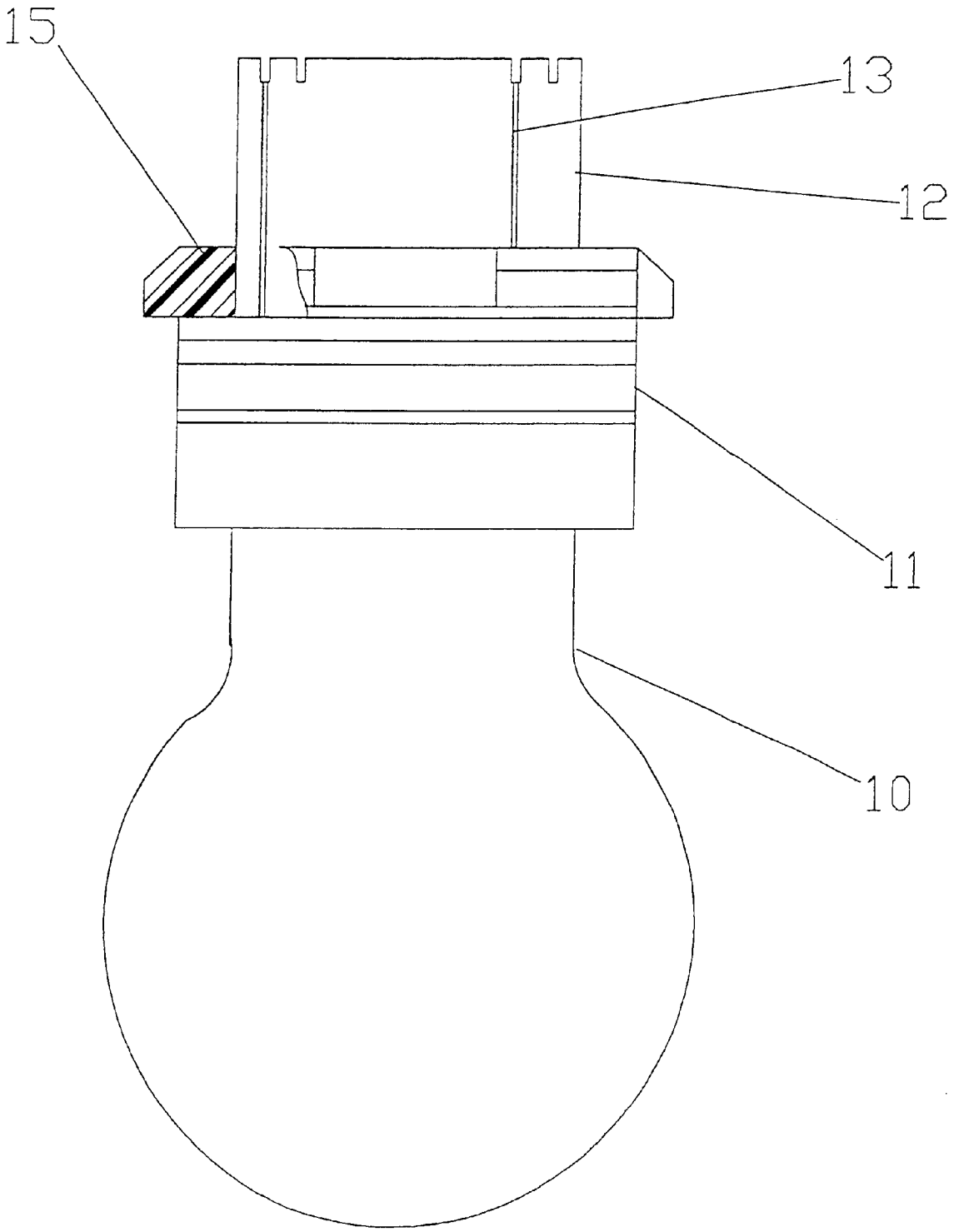
Fig.1 PRIOR ART
FIG. 1 is a perspective view of the known bulb socket assembly using by the common automobile.
Figure 2:
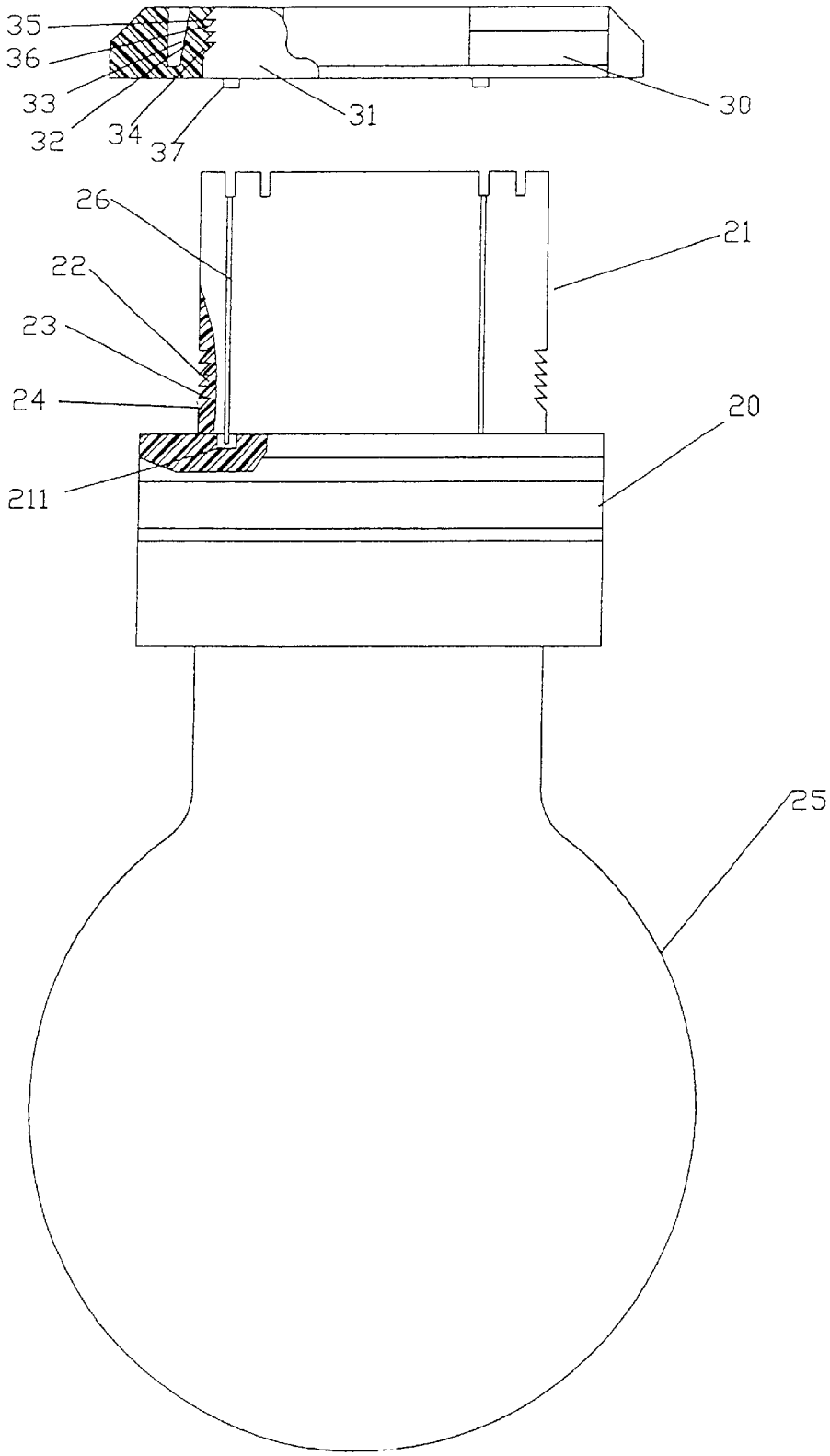
FIG. 2 is a perspective view of the bulb socket and fixed-frame according to a preferred embodiment of the present invention.

With reference to FIG. 2, it shows a preferred embodiment of the present invention comprising a bulb socket (20) and a fixed-frame.

Figure 3:
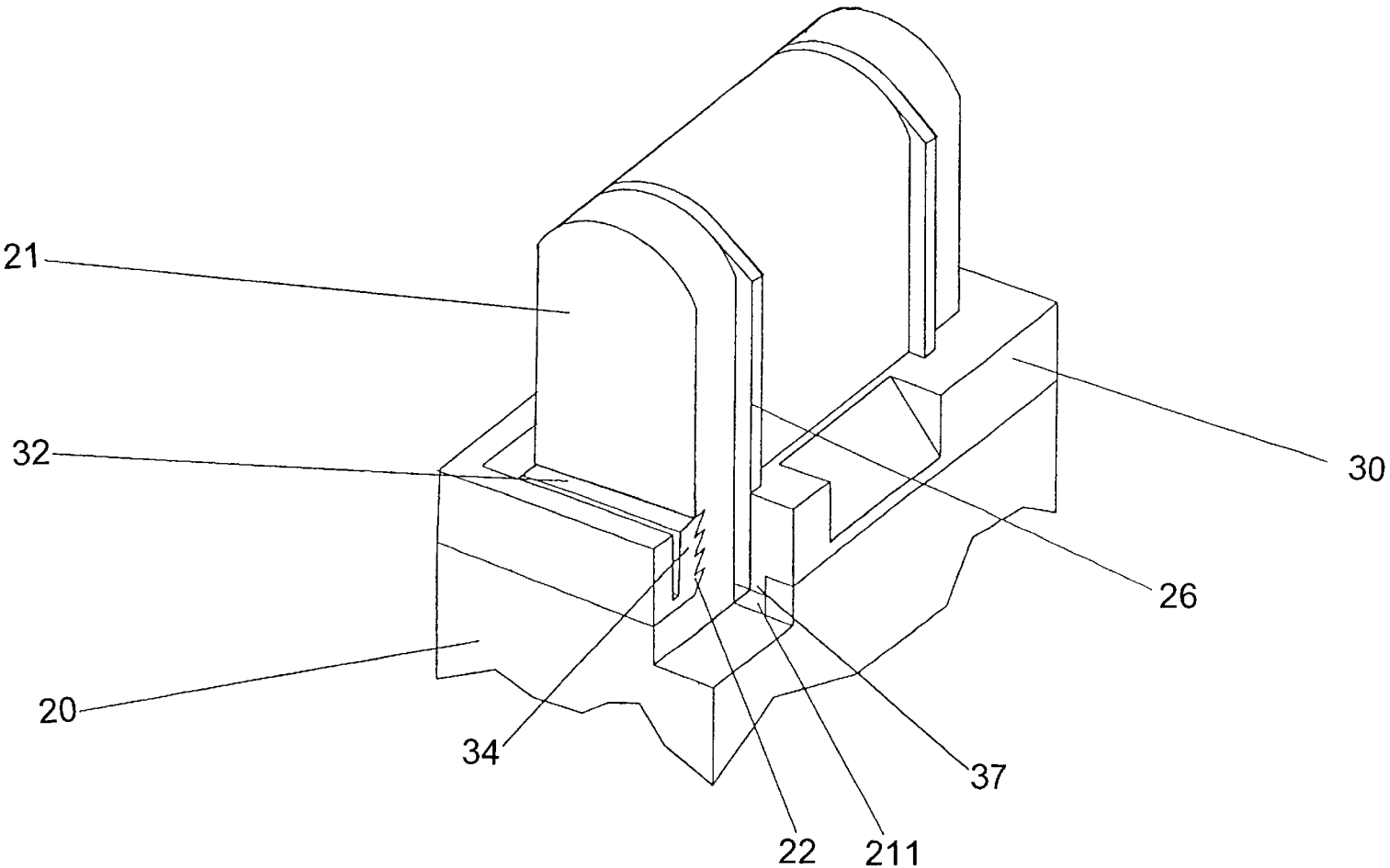
FIG. 3 is a stereographic perspective view of the bulb socket assembly with a fixed-frame according to a preferred embodiment of the present invention.

The bulb socket (20), as shown in FIG. 2 and FIG. 3, is made from an engineering plastic material and is integrated into one-piece configuration. At one of its ends it extends to a straight leading-in socket (21). There are four locating grooves (211) which are not only divided into 2 sets but also installed at the front/back end. The locating grooves are at the section that is adjacent to the leading-in socket (21), of the bulb socket (20). The locating grooves (211) form a shape of invagination and extend to a proper depth. There is a chucking member (teeth) (22) installed at the position near the bottom end on each side of the leading-in socket (21). The invaginated chucking member (22) is configured of a plane (23) which is conjoined with a slope (24) extending downward to form a plurality of indent ratchets. A glass shell (25), which is connected with a plurality of electric lead wires (26), is affixed to the bulb socket (20) so as to have a configuration with the lead wires having either the positive or negative electrode. Additionally, the lead wires (26) will be threaded through the leading-in socket (21) and thereby will then be folded and abutted against the surface of the leading-in socket (21). The lead wires (26) will extend to an applicable length and also will have one of their ends threaded into the locating groove (211) in order that it could be affixed to the exact position.

Figure 4:
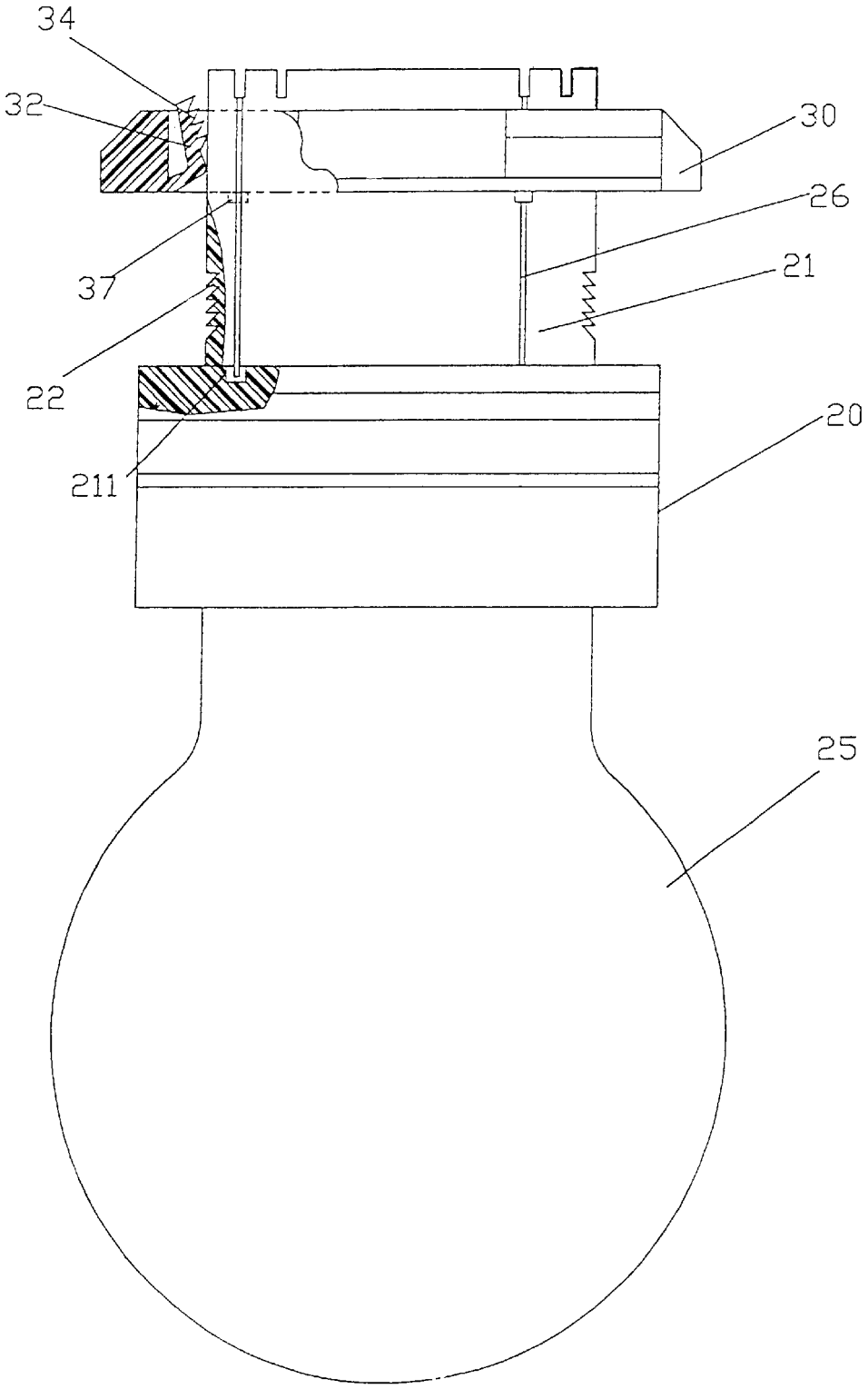
FIG. 4 is a perspective cross-sectional view of the portion of the fixed-frame having a leading-in socket which is telescoped into a bulb socket according to a preferred embodiment of the present invention.

In the rectangular fixed-frame (30), referring to the FIGS. 2 to 4, there is a central hole (31) coupled with the leading-in socket (21). There is a pressing piece (32) installed onto the side end of the chucking member (22) at the position where it is opposite to the central hole (31). The bottom end of the pressing piece (32) is connected to the fixed-frame (30) and the other end is then extended freely and flexibly to an applicable length. The pressing piece (32) has an inside slope (33) with its thickness reduced gradually so as to have better flexibility. At one side of the slope (33) is a space in order that the pressing piece (32) will be movable and flexible freely. On the side of the pressing piece (32) is a blocking member (teeth) (34) installed at the position adjacent to the chucking member (22). The blocking member (34) protrudes outward and includes a plane (35) which is conjoined with a slope (36) extending downward to form a plurality of indent ratchets. There are four pieces of invaginated locating posts (37) equipped onto the bottom end of the fixed-frame (30) at the position opposite to the locating groove (211) of the leading-in socket (21). The locating post (37) will be coupled firmly with the locating groove (211) in order to form, through each other, a firmly fixed structure.

According to the above configuration, while assembling the device according to the present invention, and with reference to FIG. 4, the central hole (31) of the fixed-frame (30) will couple with the leading-in socket (21) of the bulb socket (20). The fixed-frame (30) will then also be able to be coupled with the lead wire (26) by grooves positioned on the interior circumference of the central hole (31). The lead wire (26) will be abutted against the surface of the leading-in socket (21) while one end of the lead wire (26) is threaded into the locating groove (211) and affixed thereby, to form structure with the fixed array.

While the fixed-frame (30) is affixed to the upper straight portion of the leading-in socket (21), it will depress the chucking member (22) located on one side of the pressing piece (32). Hence, the slope (36) will be forced to depress against the pressing piece (32), causing the free end on the pressing piece (32) to flex, and then deflect closely to the space aside to the slope (33), so that the fixed-frame (30) will be able to slide further downward. In the meantime, the blocking member (34) positioned at one side of the pressing piece (32) will approach the chucking member (22) aside to the leading-in socket (21).

Figure 5:
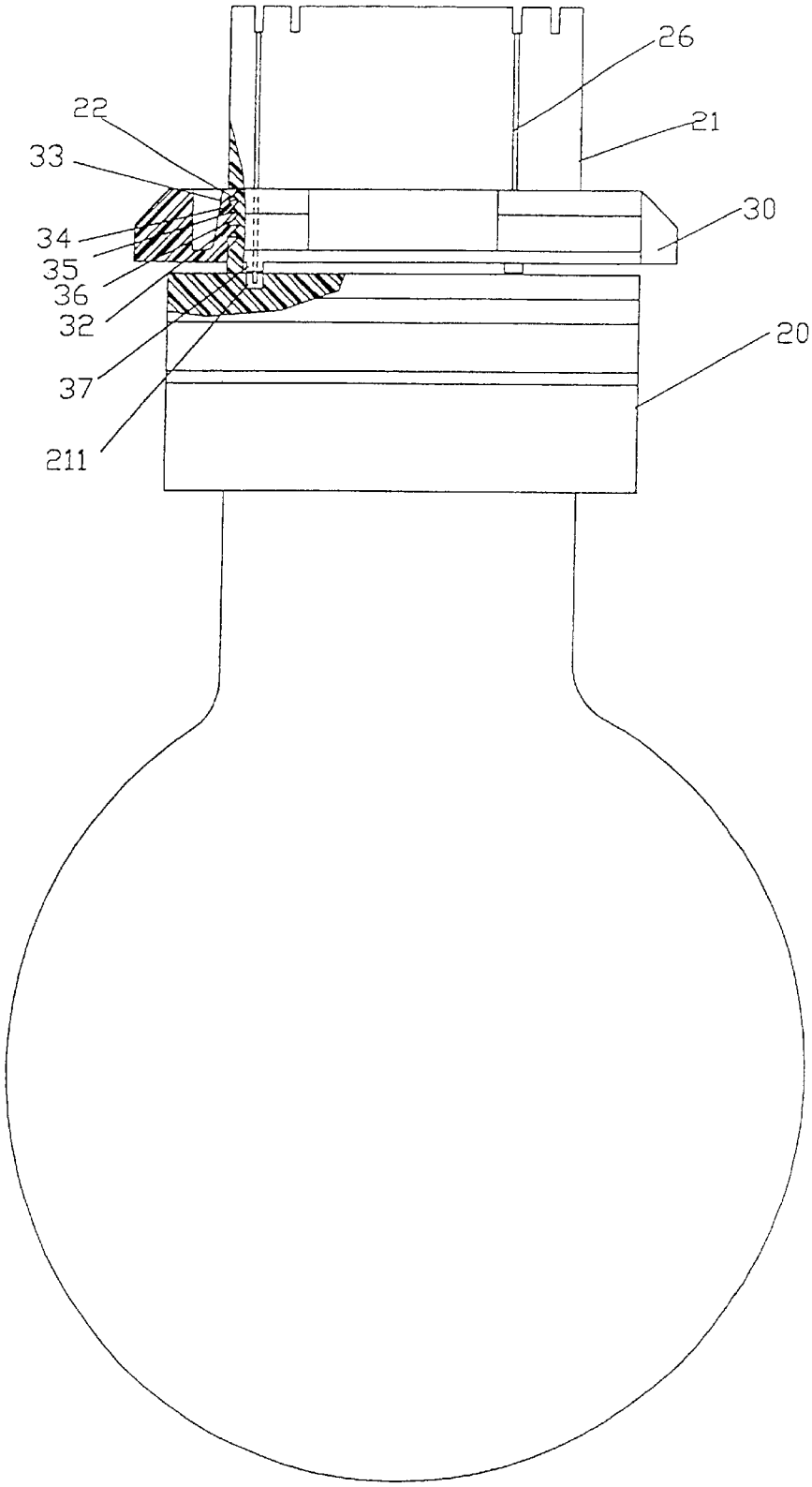
FIG. 5 is a perspective view of a preferred embodiment of the present invention showing a chucking member which is firmly coupled each other with a blocking member thereby.

By means of the interaction in-between the depressing and re-flexible force against the pressing piece (32), with reference to FIG. 5, the blocking member (34) will act as a protruded ratchet, while the chucking member (22) will act as a corresponding invaginated ratchet. The blocking member (34) will be able to be inserted into the invaginated space formed by the chucking member (22) ratchet while it acts as a protruded ratchet. Therefore, the planes (23), (35) will become adjacent to each other, and the slope (24), (36) will be abutted against each other to form a firmly coupled structure.

According to the present invention, the blocking member (34) is coupled with the chucking member (22), the slopes (24), (36) will be abutted against each other to the incline direction. Thus, both the slopes (24) (36) will be able to slide against each other in such a way the fixed-frame (30) will be able to move downward until the moving action of the fixed-frame (30) coupled will then reach the dead-end of the leading-in socket (21). If the moving action of the fixed-frame (30) does not reach the dead-end of the leading-in socket (21), the plane (23) will stop the plane (35) from moving upward, and thus have the fixed-frame (30) affixed firmly to the bottom end of the leading-in socket (21) without falling off.

By utilizing the function which allows the plane (23) to stop the plane (35) from moving upward, the blocking member (34) will be affixed firmly to the chucking member (22) without falling off at all. In this way, the fixed-frame (30) will not only be affixed directly onto the leading-in socket (21), but will also be able to be assembled rapidly without falling off, so that it is applicable for the fixed-frame (30) to be assembled rapidly onto the leading-in socket (21) of the bulb socket (20) with the lead wire (26) of the said bulb socket (20) being fixed properly as well.

Figure 6:
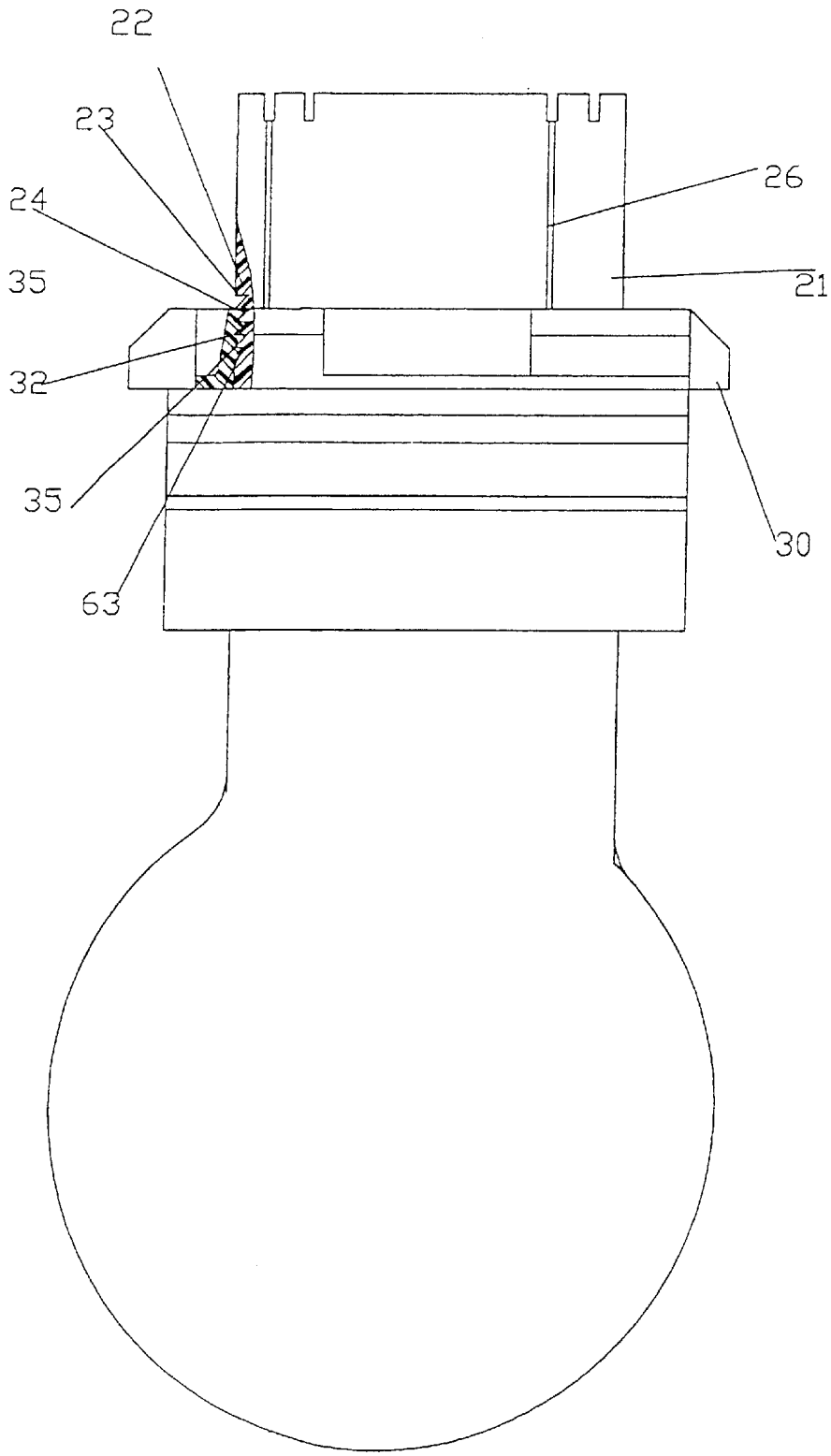
FIG. 6 is a perspective cross-sectional view of a preferred embodiment of the present invention showing the firmly coupled section in the leading-in socket wherefrom a fixed-frame is telescoped into a bulb socket accordingly.
Figure 7:
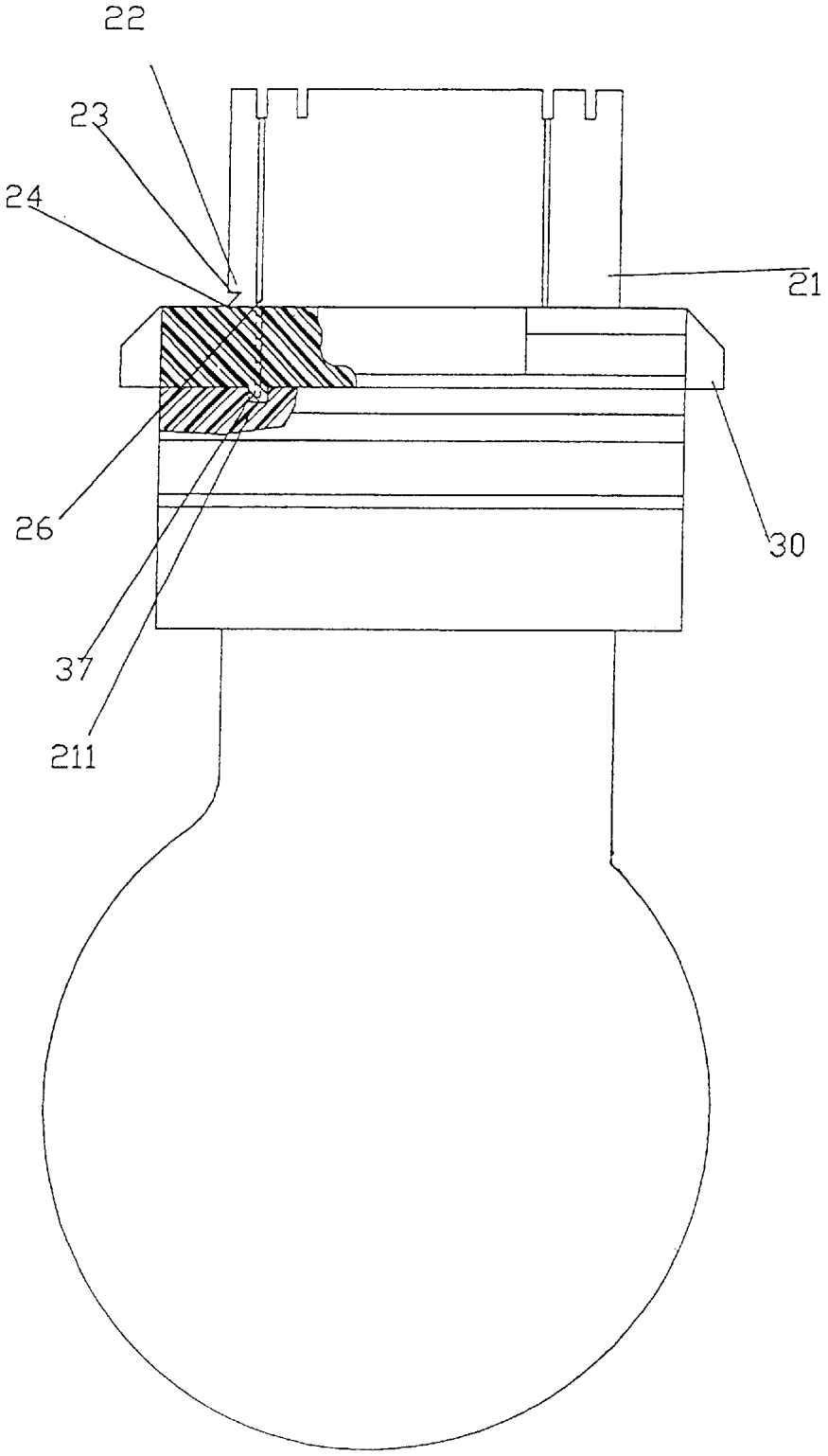
FIG. 7 is a perspective cross-sectional view of a preferred embodiment of the present invention wherefrom a locating post of the fixed-frame is firmly coupled with a locating groove of the bulb socket accordingly.

A quotable achievement of the present invention is that, if referring to FIGS. 2,6 and 7, upon the assembling, the lead wire (26) will be folded and abutted against the surface of the leading-in socket (21). One end of the lead wire (26) will then be threaded into the locating groove (212) and affixed thereby. Thus, the central hole (31) of the fixed-frame (30) will be affixed to the leading-in socket (21) of the bulb socket (20). At the same time, the central hole (31) of the fixed-frame (30) will also depress the lead wire (26), so the side of the lead wire (26) will be fixed in proper position so as to have it abutted onto the fixed position located on the leading-in socket (21). In this way, the bulb socket (20) will be coupled firmly with the fixed-frame (30), and the central portion of the lead wire (26) will be depressed firmly and also its end portion will be affixed tightly so that it is applicable for a rapid assembly without having a defect of deflection. In addition, the location post (37) positioned on the bottom end of the fixed-frame (30) will be able to be coupled with the opposite locating groove (211) in order to ensure that the fixed-frame (30) and the bulb socket (20) will be affixed together tightly. Also, the locating post (37) will depress the lead wire (26) so as to form a structure with a proper array without any deflection or dropping off. Thus the lead wire (26) will be lined up and affixed onto a fixed position in order that the bulb socket (20) will be coupled with the bulb holder properly and also the lead wire (26) will be able to be connected to the positive/negative electrode of the power supply thereby without the defects such as deflection, falling off, improper connection with the electrodes etc. from the known lead wires of the common bulb socket. Thus it will definitely be able to improve both the reliability and quality of the bulb socket according to the improved structure of the present invention.

In light of the above, the improved fixed-device for the bulb socket according to the present invention, which is a kind of fixed-frame affixed onto the bulb socket comprising a leading-in socket and a chucking member and also a blocking member installed onto the end adjacent to the said fixed-frame so as to configure the structure with both invaginated and protruded ratchets, and wherein the said chucking member and the said blocking member will be coupled firmly with each other, and moreover it will be able to achieve all the characteristics of rapid assembly, firmly coupling and also with all the advantages by the utilization in industries if it is also equipped with the locating post and locating groove as well.

In view of the specific embodiment described herein, whereby are the preferred embodiments of the present invention only, all variation and modification of the invention hereby are intended to be covered by the spirit of the invention and the scope of the claims.

What is claimed is:

1. An improved fixing arrangement for a bulb socket, comprising:

a bulb socket having a bulb affixed thereto;

a leading-in socket extending from said bulb socket, said leading-in socket having a plurality of sequentially arranged teeth on a side thereof, said sequentially arranged teeth having a tapered configuration;

a plurality of electric lead wires disposed on the side of said leading-in socket; and a fixed-frame having an opening through which said leading-in socket projects, and having a flexible pressing piece that projects into the opening, said pressing piece having a plurality of further sequentially arranged teeth on a side thereof, said further sequentially arranged teeth having a tapered configuration, wherein when said fixed-frame is positioned around said leading-in socket, said sequentially arranged teeth engage with said further sequentially arranged teeth to firmly affix said fixed-frame to said leading-in socket.

2. The fixing arrangement as recited in claim 1, wherein said sequentially arranged teeth and said further sequentially arranged teeth are arranged to point one of upwards and downwards, said further sequentially arranged teeth and said sequentially arranged teeth pointing in opposite directions so that said sequentially arranged teeth slide over said sequentially arranged teeth when said fixed-frame is slid down said leading-in socket in a direction toward the bulb, and so that said sequentially arranged teeth and said further sequentially arranged teeth engage with each other to prevent said fixed frame from being slid up said leading-in socket in a direction away from the bulb.

3. The fixing arrangement as recited in claim 1, wherein said pressing piece is fixed at one end and free at another end.

4. The fixing arrangement as recited in claim 5, wherein said bulb socket has a plurality of locating grooves disposed adjacent to said leading-in socket; wherein each lead wire extends into a respective locating groove; and wherein said fixed-frame has a plurality of locating posts disposed at a bottom portion thereof, each locating post being received within a respective locating groove when said fixed-frame is positioned around said leading-in socket with said sequentially arranged teeth engaged with said further sequentially arranged teeth, said lead wires being affixed within the respective locating grooves by the respective locating posts.

* * * * *